US005720093A

United States Patent [19]

Yoder, Jr.

[11] Patent Number: 5,720,093

[45] Date of Patent: Feb. 24, 1998

[54] METHOD OF BUILDING OUTDOOR FURNITURE

[76] Inventor: James Herbert Yoder, Jr., 1111 Daniels Church Rd., Lincolnton, N.C. 28092

[21] Appl. No.: 585,482

[22] Filed: Jan. 16, 1996

[51] Int. Cl.[6] ..... B23P 19/02; B23P 11/02

[52] U.S. Cl. ..... 29/426.4; 29/525.02; 206/223; 206/326; 206/497; 297/440.24

[58] Field of Search ..... 29/426.4, 525.02; 206/223, 326, 497, 576, 597; 297/440.24, 452.63, 452.2

[56] References Cited

U.S. PATENT DOCUMENTS

| | | | |
|---|---|---|---|
| 2,660,228 | 11/1953 | Reinhold | 206/326 |
| 3,727,981 | 4/1973 | Ostroff et al. | 206/326 |
| 4,588,227 | 5/1986 | Austin | 297/440.24 |
| 5,427,435 | 6/1995 | Yoder, Jr. | 297/440.24 |
| 5,498,054 | 3/1996 | Tomlinson | 297/440.24 |

FOREIGN PATENT DOCUMENTS

| | | | |
|---|---|---|---|
| 678840 | 9/1952 | United Kingdom | 206/326 |

*Primary Examiner*—P. W. Echols
*Attorney, Agent, or Firm*—Michael I. Kroll

[57] ABSTRACT

A method of building outdoor furniture in which the components being a plurality of patio squares (24), hollow tubes (28), 90 degree elbow joints (30), 45 degree elbow joints (**30*a*), 22.5 degree elbow joints (30*b*), tee joints (32), end caps (34), braces (36), hinges (38), screws (40), bolts (42), washers (44) and nuts (46) can be assembled together to construct a lawn chair (48), a table (72) or a lounge chair (80**).

7 Claims, 6 Drawing Sheets

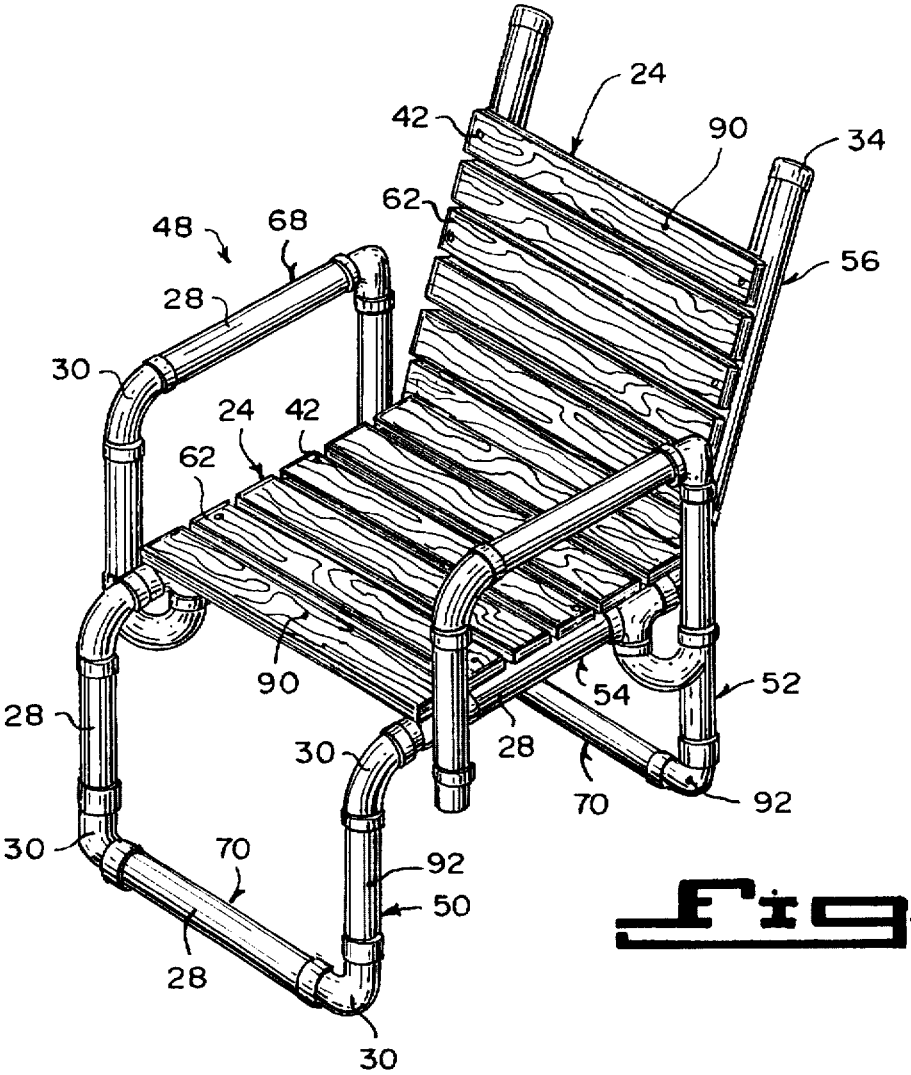
Fig. 13
Fig. 14
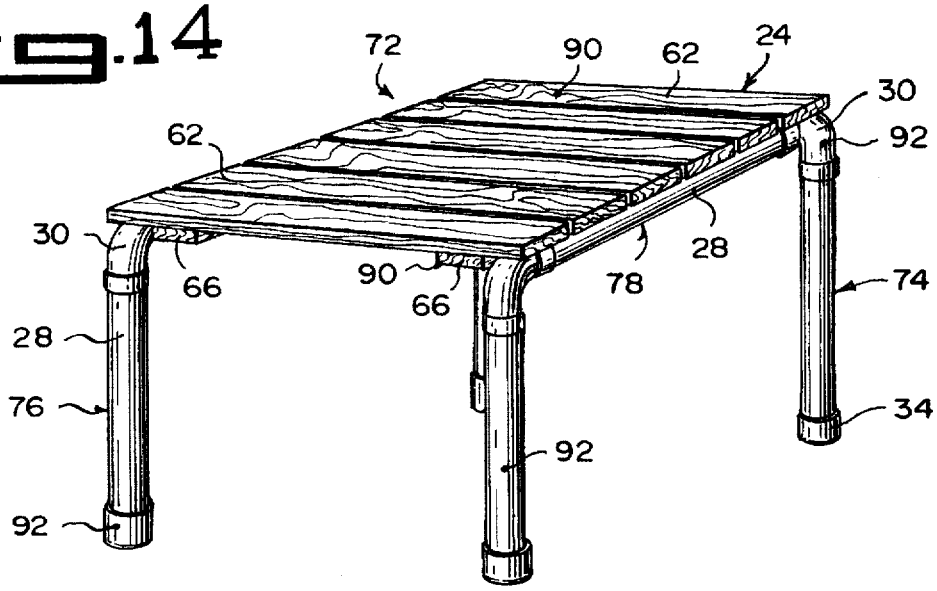

METHOD OF BUILDING OUTDOOR FURNITURE

BACKGROUND OF THE INVENTION

1. Field of the Invention

The instant invention relates generally to lawn furniture and more specifically it relates to a method of building outdoor furniture.

2. Description of the Prior Art

Numerous types of lawn furniture have been provided in prior art that are adapted to be utilized outdoors, such as in a yard, on a patio and on a beach, which will normally resist rust and sun damage. While these units may be suitable for the particular purpose to which they address, they would not be as suitable for the purposes of the present invention as heretofore described.

SUMMARY OF THE INVENTION

A primary object of the present invention is to provide a method of building outdoor furniture that will overcome the shortcomings of the prior art devices.

Another object is to provide a method of building outdoor furniture in which the components can come packaged in a kit or separately, so that the components can be assembled to construct a piece of furniture, such as a lawn chair, a chaise lounge, a table and/or a leg rest.

An additional object is to provide a method of building outdoor furniture in which prefabricated patio squares are utilized, so that they can be quickly assembled to the rest of the components to form a sturdy seat, back rest, leg rest and/or table top.

A further object is to provide a method of building outdoor furniture that is simple and easy to use.

A still further object is to provide a method of building outdoor furniture that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 8A:
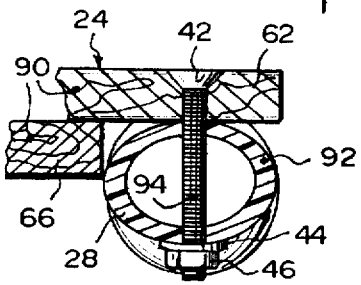
FIG. 8 is a perspective view with parts broken away and in section, showing the nuts completely tightened upon the threaded shanks of the bolts.
Figure 8:
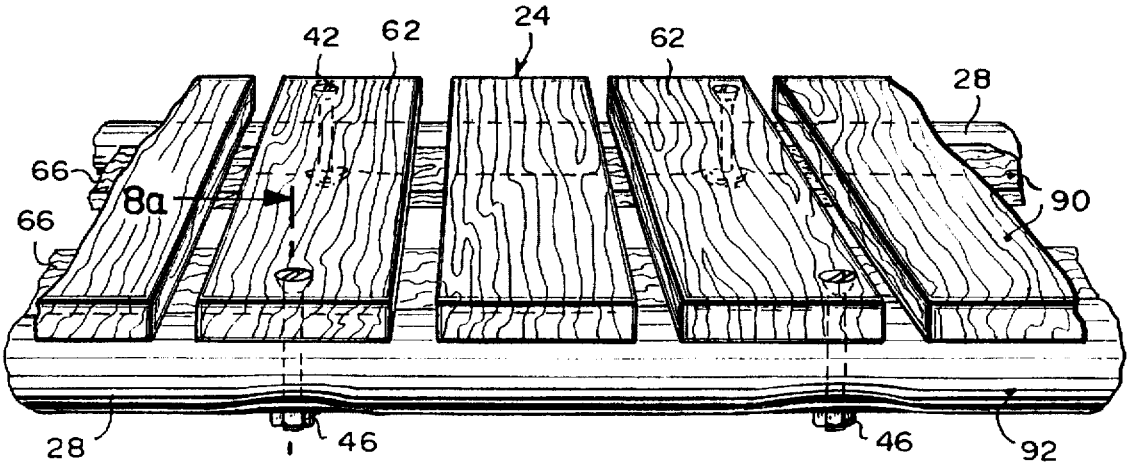

FIG. 8*a* is a cross sectional view taken along line 8*a*—8*a* in FIG. 8.

Figure 9:
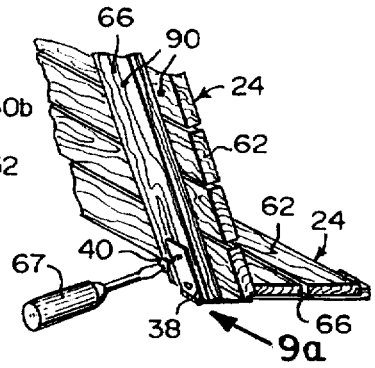

FIG. 9 is a partial perspective view, showing the installation of one hinge connecting two patio squares together, to form a seat and backrest of a lawn chair.

Figure 9A:
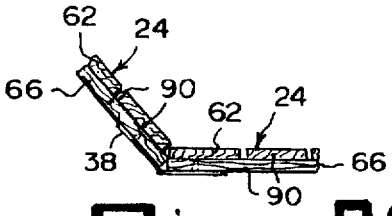

FIG. 9*a* is a side view taken in the direction of arrow 9*a* in FIG. 9.

Figure 10:
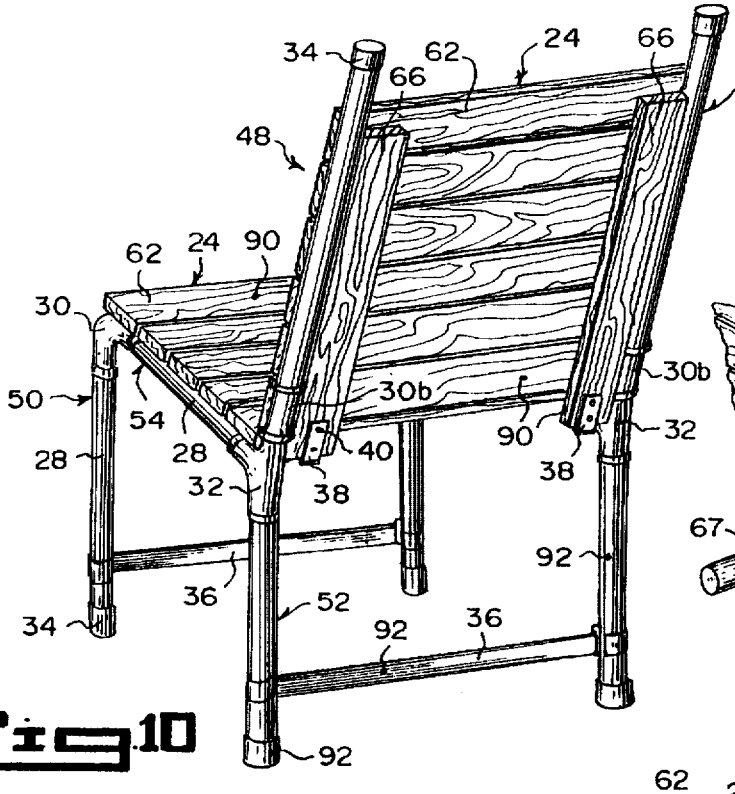

FIG. 10 is a rear perspective view of the lawn chair assembled in accordance with the various components of the instant invention.

Figure 11:
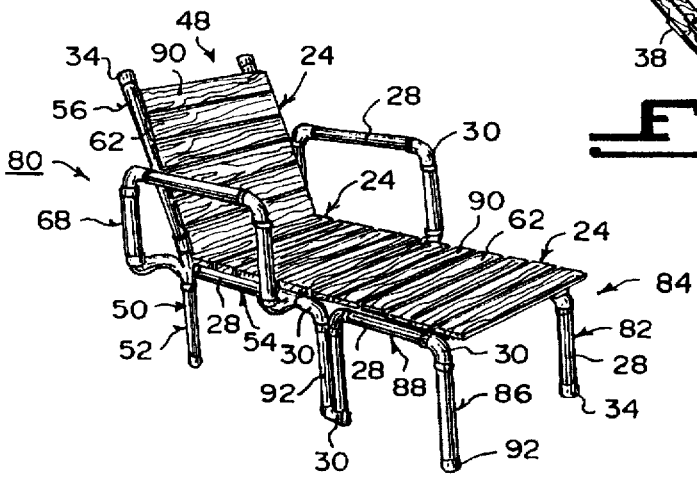

FIG. 11 is a front perspective view of a chaise lounge assembled in accordance with the various components of the instant invention.

Figure 12:
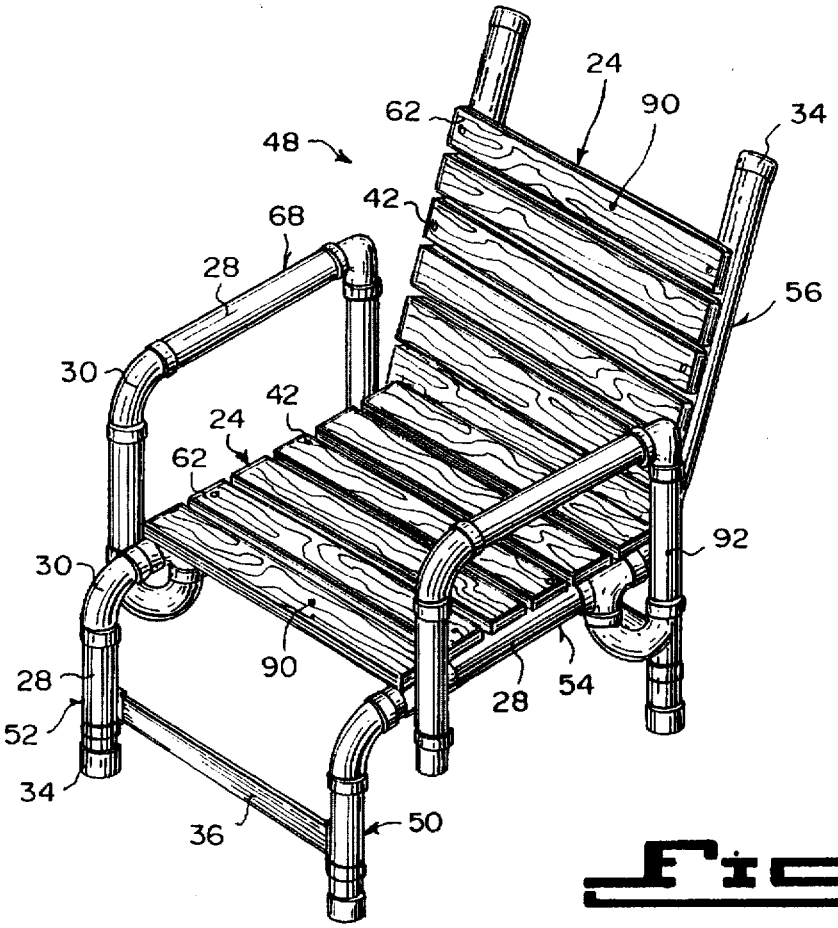

FIG. 12 is a front perspective view of a lawn chair with armrests assembled in accordance with the various components of the instant invention.

FIG. 13 is a front perspective view similar to FIG. 12, showing stretchers instead of braces extending between the front legs and the rear legs of the lawn chair.

FIG. 14 is a perspective view of a table assembled in accordance with the various components of the instant invention.

Similar reference characters denote corresponding features consistently throughout the attached drawings.

DETAILED DESCRIPTION OF THE PREFERRED EMBODIMENTS

Figure 1:
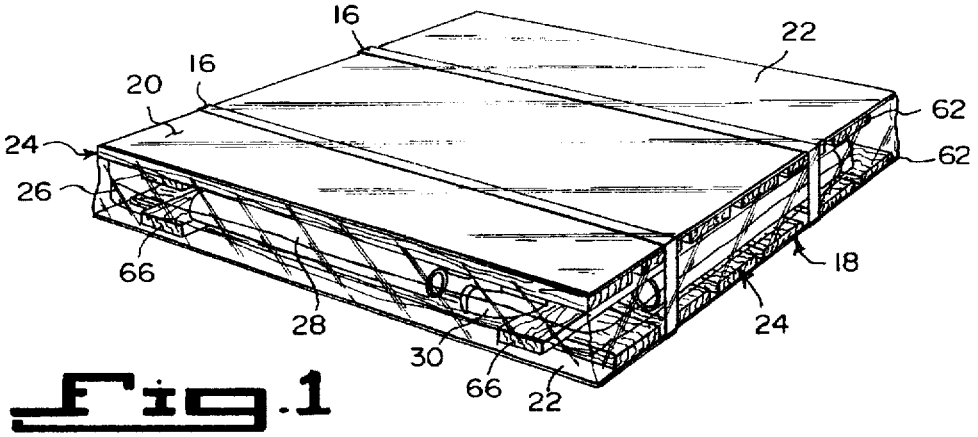
FIG. 1 is a perspective view of the instant invention in a packaged kit.
Figure 2:
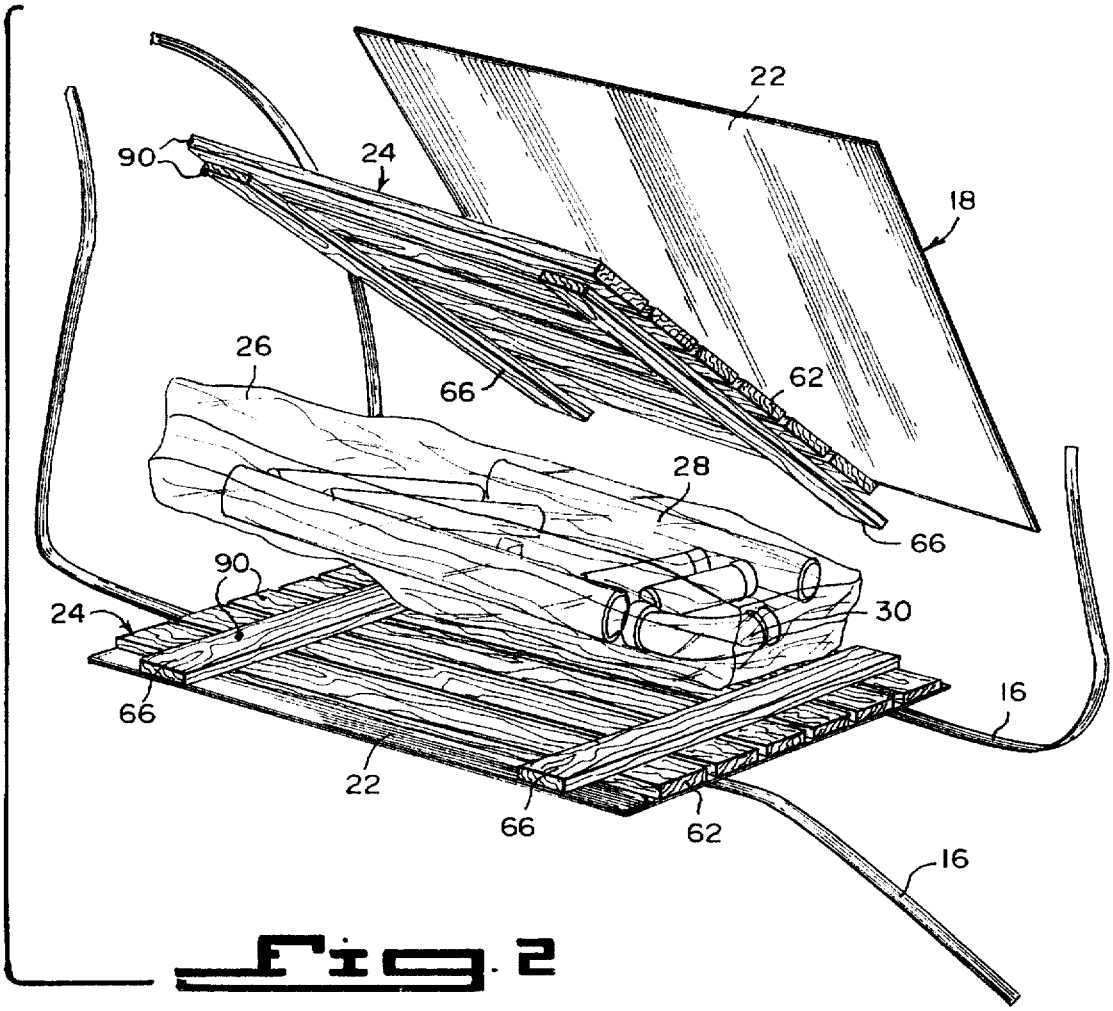
FIG. 2 is a perspective view of the instant invention with the packaged kit partly opened.

Turning now descriptively to the drawings, in which similar reference characters denote similar elements throughout the several views, FIGS. 1 through 14 illustrate a method of building outdoor furniture comprising the following steps:

Step 1 is breaking two bands 16 of a kit 18 having a shrink wrap 20 about two cardboard covers 22 over two patio squares 24, with a plastic bag 26 therebetween holding a plurality of hollow tubes 28, 90 degree elbow joints 30, 45 degree elbow joints 30*a*, 22.5 degree elbow joints 30*b*, tee joints 32, end caps 34, braces 36, hinges 38, screws 40, bolts 42, washers 44 and nuts 46, (see FIGS. 1 and 2).

Step 2 is removing the shrink wrap 20 to separate the patio squares 24 from the cardboard covers 22.

Figure 3:
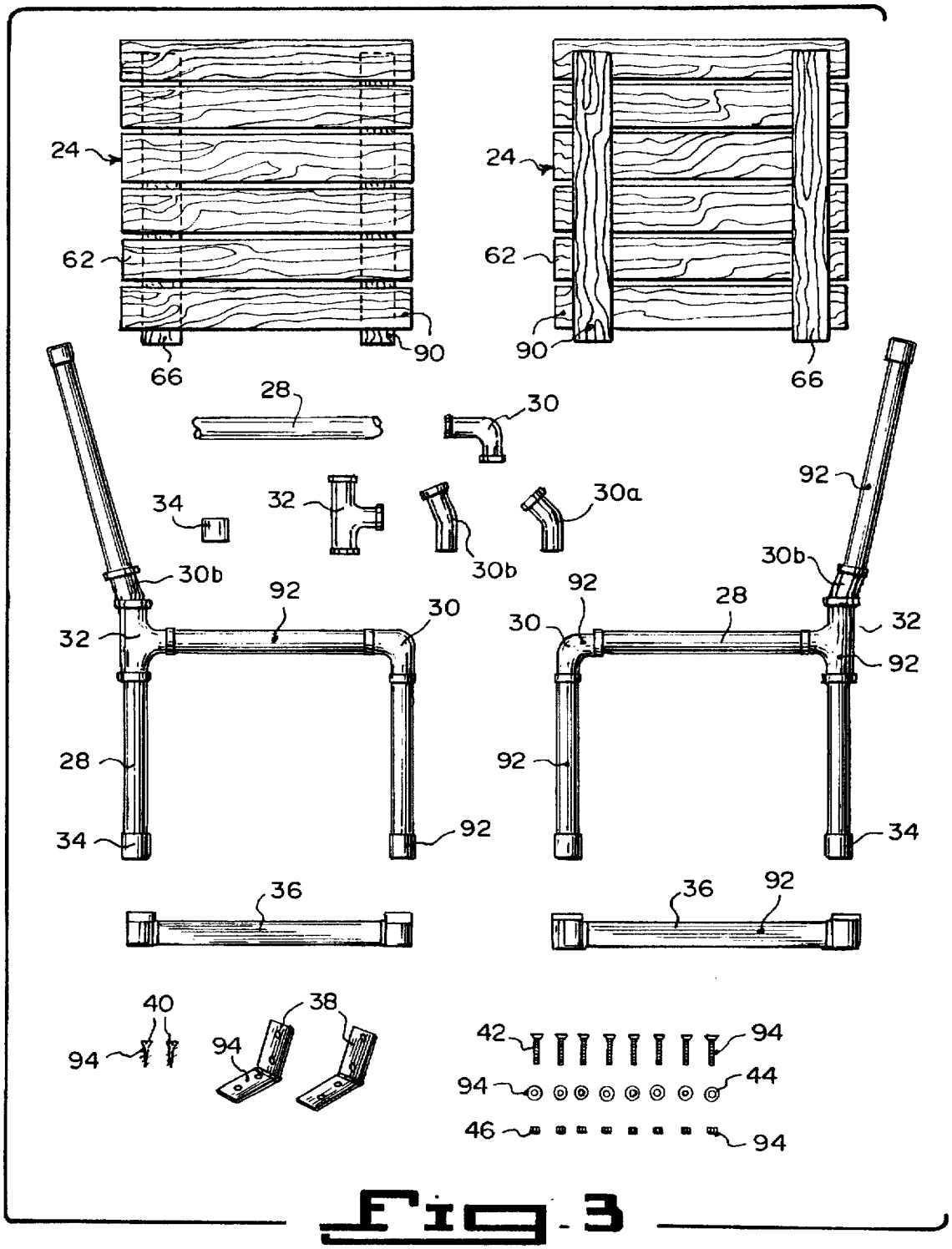
FIG. 3 is a plan view showing the various components separated from the packaged kit.

Step 3 is opening the plastic bag 26 to remove the plurality of hollow tubes 28, 90 degree elbow joints 30, 45 elbow joints 30*a*, 22.5 degree elbow joints 30*b*, tee joints 32, end caps 34, braces 36, angle brackets 38, screws 40, bolts 42, washers 44 and nuts 46 from the plastic bag, (see FIG. 3).

To fabricate a lawn chair 48 as shown in FIGS. 10, 12 and 13, the steps are as follows:

Step 1 is assembling the plurality of hollow tubes 28, 90 degree elbow joints 30, 45 degree elbow joints 30*a*, 22.5 degree elbow joints 30*b*, tee joints 32, end caps 34 and braces 36 together to form a frame 50 of the lawn chair 48 having four legs 52, a seat segment 54 and a backrest segment 56.

Step 2 is positioning the first patio square 24 onto the seat segment 54 of the frame 50.

Figure 4:
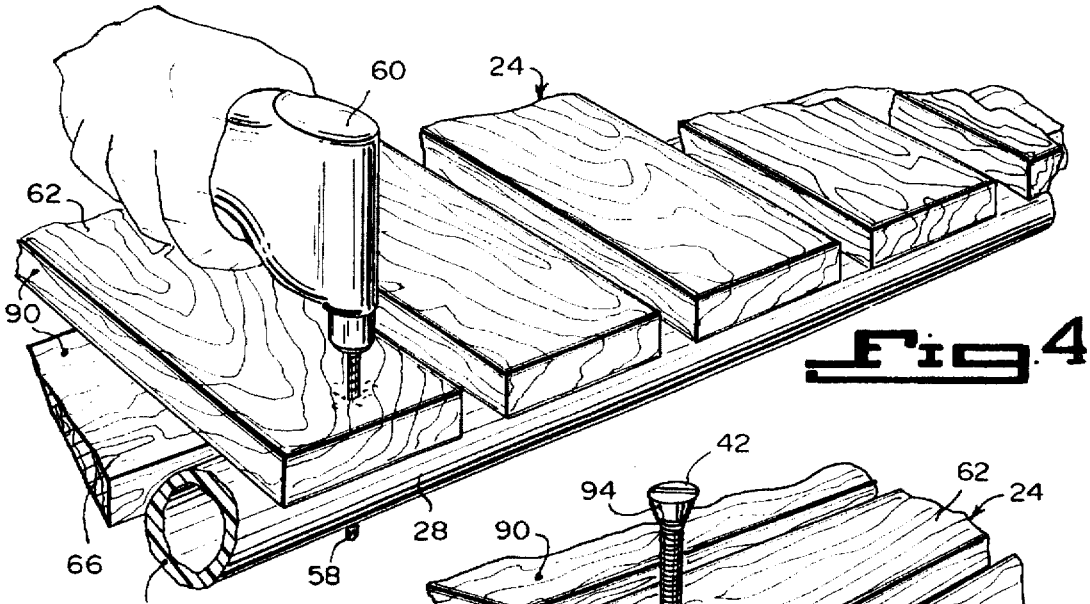
FIG. 4 is a perspective view with parts broken away and in section, showing holes being drilled by an electric drill through one of the planks of the patio square and into the hollow tube of the frame.

Step 3 is drilling a plurality of holes with a drill bit 58 of an electric drill 60 through planks 62 on the first patio square 24 and through the hollow tubes 28 of the seat segment 54 of the frame 50 (see FIG. 4).

Figure 5:
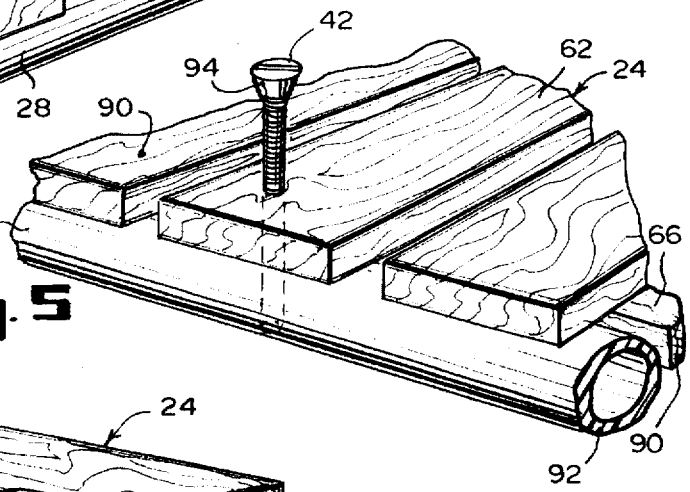
FIG. 5 is a perspective view with parts broken away and in section, showing a bolt partly inserted through the drilled holes.

Step 4 is inserting a bolt 42 through each of the holes in the planks 62 of the first patio square 24 and the hollow tubes 28 of the seat segment 54 of the frame 50 (see FIG. 5).

Step 5 is putting a washer 44 onto each of the threaded shanks of the bolts 42.

Figure 6:
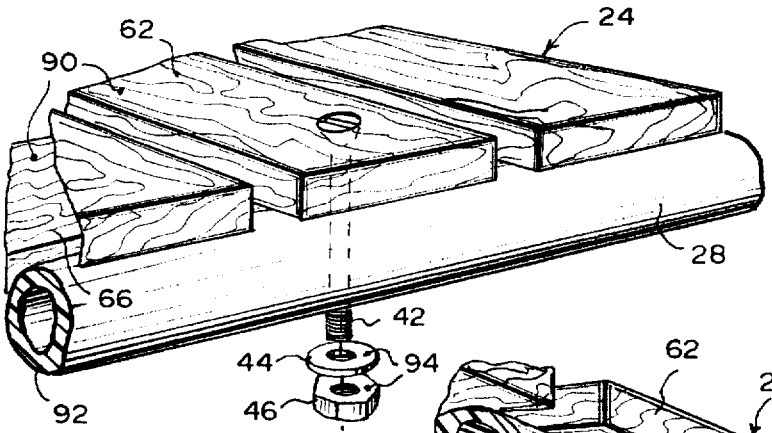
FIG. 6 is a perspective view with parts broken away and in section, showing a washer and nut ready to be placed upon the threaded shank of the bolt.

Step 6 is threading a nut 46 onto each of the threaded shanks of the bolts 42 (see FIG. 6).

Figure 7:
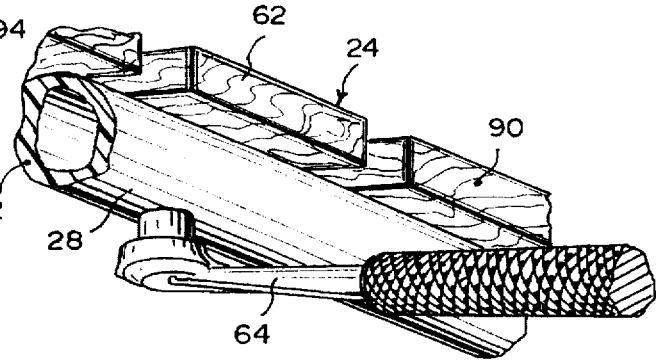
FIG. 7 is a perspective view with parts broken away and in section, showing a socket wrench tightening the nut upon the threaded shank of the bolt.

Step 7 is tightening the nuts 46 with the washers 44 against the hollow tubes 28 of the seat segment 54 of the frame 50 with a socket wrench 64, so that the nuts 46 will torque to compress the hollow tubes 28 of the seat segment 54 of the frame 50, to give stability thereto (see FIGS. 7, 8 and 8*a*).

Step 8 is positioning the second patio square 24 onto the backrest segment 56 of the frame 50.

Step 9 is drilling a plurality of holes with the drill bit 58 of the electric drill 60 through planks 62 on the second patio square 24 and through the hollow tubes 28 of the backrest segment 56 of the frame 50 (see FIG. 4).

Step 10 is inserting a bolt 42 through each of the holes in the planks 62 of the second patio square 24 and the hollow tubes 28 of the backrest segment 56 of the frame 50 (see FIG. 5).

Step 11 is putting a washer 44 onto each of the threaded shanks of the bolts 42.

Step 12 is threading a nut 46 onto each of the threaded shanks of the bolts 42 (see FIG. 6).

Step 13 is tightening the nuts 46 with the washers 44 against the hollow tubes 28 of the backrest segment 56 of the frame 50 with the socket wrench 64, so that the nuts 46 will torque to compress the hollow tubes 28 of the backrest segment 56 of the frame 50, to give stability thereto (see FIGS. 7, 8 and 8*a*).

Step 14 is placing the hinges 38 against abutting stringers 66 between the first patio square 26 and the second patio square 26.

Step 15 is screwing the screws 40 with a screwdriver 67 through holes in the hinges 38 and into the stringers 66 of the first patio square 24 and the second patio square 24, to provide additional stability thereto (see FIGS. 9 and 9*a*).

Step 16 is assembling additional hollow tubes 28 and 90 degree elbow joints 30 to the frame 50, for form two armrests 68 (see FIGS. 12 and 13).

Step 17 is removing the two braces 36 from the frame 50.

Step 18 is removing the end caps 34 from bottom ends of the two front legs 52 and the two rear legs 52 of the frame 50.

Step 19 is assembling two 90 degree elbows 30 and a hollow tube 28 between the bottom ends of the two front legs 52 of the frame 50, to form a first stretcher 70.

Step 20 is assembling two 90 degree elbows 30 and a hollow tube 28 between the bottom ends of the two rear legs 52 of the frame 50 to form a second stretcher 70 (see FIG. 13).

To fabricate a table 72, as shown in FIG. 14, the steps are as follows:

Step 1 is assembling a plurality of the hollow tubes 28, 90 degree elbow joints 32 and end caps 34 together to form a frame 74 of the table 72 having four legs 76 and a table top segment 78.

Step 2 is positioning one of the patio squares 24 onto the table top segment 78 of the frame 74.

Step 3 is drilling a plurality of holes with a drill bit 58 of an electric drill 60 through planks 62 of the patio square 24 and through the hollow tubes 28 of the table top segment 78 of the frame 74 (see FIG. 4).

Step 4 is inserting a bolt 42 through each of the holes in the planks 62 of the patio square 24 and the hollow tubes 28 of the table top segment 78 of the frame 74 (see FIG. 5).

Step 5 is putting a washer 44 onto each of the threaded shanks of the bolts 42.

Step 6 is threading a nut 46 onto each of the threaded shanks of the bolts 42 (see FIG. 6).

Step 7 is tightening the nuts 46 with the washers 44 against the hollow tubes 28 of the table top segment 78 of the frame 74 with a socket wrench 64, so that the nuts 46 will torque to compress the hollow tubes 28 of the table top segment 78 of the frame 74, to give stability thereto (see FIGS. 7, 8 and 8*a*).

To fabricate a chaise lounge 80, as shown in FIG. 11), the steps are as follows:

Steps 1 through 17 are the same as the lawn chair 48 above.

Step 18 is assembling a plurality of the hollow tubes 28, 90 degree elbow joints 30 and end caps 34 together to form a frame 82 of a leg rest 84, having four legs 86 and a leg rest segment 88.

Step 18 is positioning an additional patio square onto the leg rest segment 88 of the frame 82.

Step 19 is drilling a plurality of holes with a drill bit 58 of an electric drill 60 through planks 62 of the additional patio square 24 and through the hollow tubes 28 of the leg rest segment 88 of the frame 82 (see FIG. 4).

Step 20 is inserting a bolt 42 through each of the holes in the planks 62 of the additional patio square 24 and the hollow tubes 28 of the leg rest segment 88 of the frame 82 (see FIG. 5).

Step 21 is putting a washer 44 onto each of the threaded shanks of the bolts 42.

Step 22 is threading a nut 46 onto each of the threaded shanks of the bolts 42 (see FIG. 6).

Step 23 is tightening the nuts 46 with the washers 44 against the hollow tubes 28 of the leg rest segment 88 of the frame 82 with a socket wrench 64, so that the nuts 46 will torque to compress the hollow tubes 28 of the leg rest segment 88 of the frame 82, to give stability thereto (see FIGS. 7, 8 and 8*a*).

Step 24 is removing each end cap 34 from a bottom end of two front legs 52 of the frame 50 of the lawn chair 48 and a bottom end of two legs 86 of the frame 82 of the leg rest 84.

Step 25 is positioning the two legs 86 of the frame 82 of the leg rest 84 without the end caps 34 adjacent the front legs 52 of the frame 50 of the lawn chair 48.

Step 26 is attaching each of two 90 degree elbow joints 30 between the bottom end of one front leg 52 of the frame 50 of the lawn chair 48 and the bottom end of one adjacent leg 86 of the frame 82 of the leg rest 84 (see FIG. 11).

Each patio square 24 is prefabricated out of two spaced apart parallel stringers 66 attached transversely to six parallel planks 62 that are all made out of wood 90. Each hollow tube 28, 90 degree elbow joint 30, 45 degree elbow joint 30*a*, 22.5 degree elbow joint 30*b*, tee joint 32, end cap 34 and braces 36 is fabricated out of polyvinyl chloride 92. Each hinge 38, screw 40, bolt 42, washer 44 and nut 46 is fabricated out of a non-corrosive durable material 94.

In FIGS. 1 and 2, the instant invention is shown as a kit 18. The various components needed for building the outdoor furniture can also be purchased separately. The various components are as follows:

A) The patio squares 24.

B) The hollow tubes 28.

C) The 90 degree elbow joints 30.

D) The 45 degree elbow joints 30*a*.

E) The 22.5 degree elbow joints 30*b*.

F) The tee joints 32.

G) The end caps 34.

H) The braces 36.

I) The angle brackets 38.

J) The screws 40.

K) The bolt 42.

L) The washers 44.

M) The nuts 46.

LIST OF REFERENCE NUMBERS

16 band
18 kit
20 shrink wrap
22 cardboard cover
24 patio square
26 plastic bag
28 hollow tube
30 90 degree elbow joint
30*a* 45 degree elbow joint
30*b* 22.5 degree elbow joint
32 tee joint
34 end cap
36 brace
38 hinge
40 screw
42 bolt
44 washer
46 nut
48 lawn chair
50 frame of 48
52 leg of 50
54 seat segment of 50
56 backrest segment of 50
58 drill bit of 60
60 electric drill
62 plank of 24
64 socket wrench
66 stringer of 24
67 screwdriver
68 armrest of 50
70 stretcher on 50
72 table
74 frame of 72
76 leg of 74
78 table top segment of 74
80 chaise lounge
82 frame of 84
84 leg rest
86 leg of 82
88 leg rest segment of 82
90 wood for 62 and 66.
92 polyvinyl chloride for 28, 30, 30*a*, 30*b*, 32, 34 and 36
94 non-corrosive durable material for 38, 40, 42, 44 and 46

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A method of building outdoor furniture from a packaged kit comprising the steps of:

a) breaking two bands of said kit having a shrink wrap about two cardboard covers over two patio squares, with a plastic bag therebetween holding accessories comprising a plurality of hollow tubes, 90 degree elbow joints, 45 degree elbow joints, 22.5 degree elbow joints, tee joints, end caps, braces, hinges, screws, bolts, washers and nuts, and each patio square being prefabricated out of two spaced apart parallel stringers attached transversely to six parallel planks that are all made out of wood and with the edges of said planks overhanging said stringers;

b) removing the shrink wrap to separate the patio squares from the cardboard covers;

c) opening the plastic bag to remove said accessories, from the plastic bag;

d) assembling said accessories to form the fixed frame of a lawn chair having four legs, a seat segment and a backrest segment, each of the seat and backrest segments having a pair of spaced hollow tubes forming opposite sides thereof;

e) positioning the first patio square onto the seat segment of the frame with each stringer on the underside of said square and between and adjacent to said spaced hollow tubes;

f) bolting said first patio square to the spaced hollow tubes forming said seat frame;

g) positioning the second patio square onto the backrest segment of the frame with each stringer on the back of said square and between and adjacent to the spaced hollow tubes forming the frame of said backrest;

h) bolting said second patio square to the spaced hollow tubes forming the frame of said backrest;

i) placing the hinges against abutting stringers between the first and second patio squares along the underside of said seat and the back side of said baskrest; and j) screwing said hinges to the abutting stringers.

2. A method of building outdoor furniture as recited in claim 1, further comprising the step of assembling additional hollow tubes and 90 degree elbow joints to the frame to form two armrests.

3. A method of building outdoor furniture as recited in claim 2, further comprising the step of removing two braces from the frame.

4. A method of building outdoor furniture as recited in claim 3, further comprising the steps of:

a) removing end caps from bottom ends of the two front legs and the two rear legs of the frame;

b) assembling two 90 degree elbows and a hollow tube between the bottom ends of the two front legs of the frame, to form a first stretcher; and c) assembling two 90 degree elbows and a hollow tube between the bottom ends of the two rear legs of the frame to form a second stretcher.

5. A method of building outdoor furniture as recited in claim 3, wherein fabricating a chaise lounge further comprises the steps of:

a) assembling a plurality of the hollow tubes, 90 degree elbow joints and end caps together to form a frame of a leg rest, having four legs and a leg rest segment;

b) positioning an additional patio square onto the leg rest segment of the frame;

c) drilling a plurality of holes with a drill bit of an electric drill through planks of the additional patio square and through the hollow tubes of the leg rest segment of the frame;

d) inserting a bolt through each of the holes in the planks of the additional patio square and the hollow tubes of the leg rest segment of the frame;

e) putting a washer onto each of the threaded shanks of the bolts;

f) threading a nut onto each of the threaded shanks of the bolts;

g) tightening the nuts with the washers against the hollow tubes of the leg rest segment of the frame with a socket wrench, so that the nuts will torque to compress the hollow tubes of the leg rest segment of the frame to give stability thereto;

h) removing each end cap from a bottom end of two front legs of the frame of the lawn chair and a bottom end of two legs of the frame of the leg rest;

i) positioning the two legs of the frame of the leg rest without the end caps adjacent the front legs of the frame of the lawn chair; and j) attaching each of two 90 degree elbow joints between the bottom end of one front leg of the frame of the lawn chair and the bottom end of one adjacent leg of the frame of the leg rest.

6. A method of building outdoor furniture as recited in claim 1, wherein each hollow tube, 90 degree elbow joint, 45 degree elbow joint, 22.5 degree elbow joint, tee joint, end cap and brace is fabricated out of polyvinyl chloride.

7. A method of building outdoor furniture as recited in claim 1, wherein each hinge, screw, bolt, washer and nut is fabricated out of a non-corrosive durable material.

* * * * *